United States Patent [19]

Szczesniak

[11] Patent Number: 4,840,121

[45] Date of Patent: Jun. 20, 1989

[54] MASTER HOLDING MECHANISM FOR DUPLICATING MACHINES

[75] Inventor: Stanley J. Szczesniak, Lindenhurst, Ill.

[73] Assignee: AM International, Inc., Chicago, Ill.

[21] Appl. No.: 935,367

[22] Filed: Nov. 26, 1986

[51] Int. Cl.[4] ..... B41F 27/12; B41F 13/54

[52] U.S. Cl. ..... 101/415.1; 101/DIG. 36

[58] Field of Search ..... 101/415.1, DIG. 12

[56] References Cited

U.S. PATENT DOCUMENTS

| | | | |
|---|---|---|---|
| 348,417 | 8/1886 | Rich | 101/415.1 |
| 2,320,239 | 5/1943 | Huck | 101/DIG. 12 |
| 2,386,214 | 10/1945 | Harrold | 101/415.1 |
| 2,608,750 | 9/1952 | Cluzel | 101/415.1 |
| 3,110,255 | 11/1963 | Jeschke | 101/415.1 |
| 3,188,952 | 6/1965 | Miller | 101/415.1 |
| 3,191,532 | 6/1965 | Hermach | 101/415.1 |
| 3,702,098 | 11/1972 | Eburn | 101/415.1 |
| 3,750,572 | 8/1973 | Etchell | 101/415.1 |
| 3,835,778 | 9/1974 | Bock | 101/415.1 |

FOREIGN PATENT DOCUMENTS

| | | | |
|---|---|---|---|
| 393868 | 4/1924 | Fed. Rep. of Germany | 101/415.1 |
| 1151000 | 7/1963 | Fed. Rep. of Germany | 101/415.1 |
| 124858 | 7/1984 | Japan | 101/415.1 |
| 1292312 | 10/1972 | United Kingdom | 101/DIG. 12 |

*Primary Examiner*—Clyde I. Coughenour

*Attorney, Agent, or Firm*—Nicholas A. Camasto; John R. Hoffman

[57] ABSTRACT

A mechanism for holding a master or printing plate on a cylinder of a duplicating or printing machine. An elongated housing, including an anvil, extends transversely across the periphery of the cylinder. A die plate extends along the housing above the anvil and defines a gap between the die plate and the anvil for receiving an edge of the master. The die plate has a series of holes spaced therealong. A pin bar extends along the housing below the anvil for moving pins into the holes in the die plate. An actuator mechanism, including pivot pins and link arms, is operatively associated between the housing and the die plate and between the housing and the pin bar for conjointly moving the die plate toward the anvil to close the gap and moving the pins through the master and into the holes in the die plate to hold the master. The pins have sharpened ends for piercing masters that are not provided with pre-punched perforations.

16 Claims, 2 Drawing Sheets

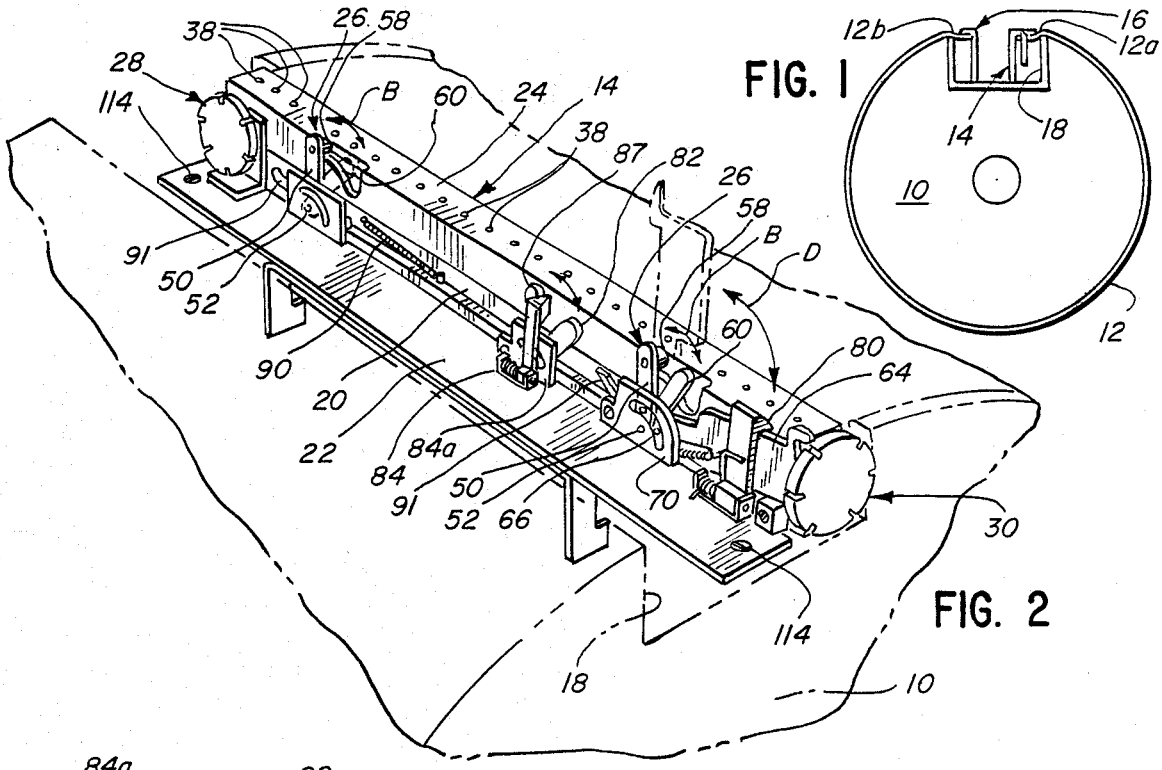
FIG. 1
FIG. 2
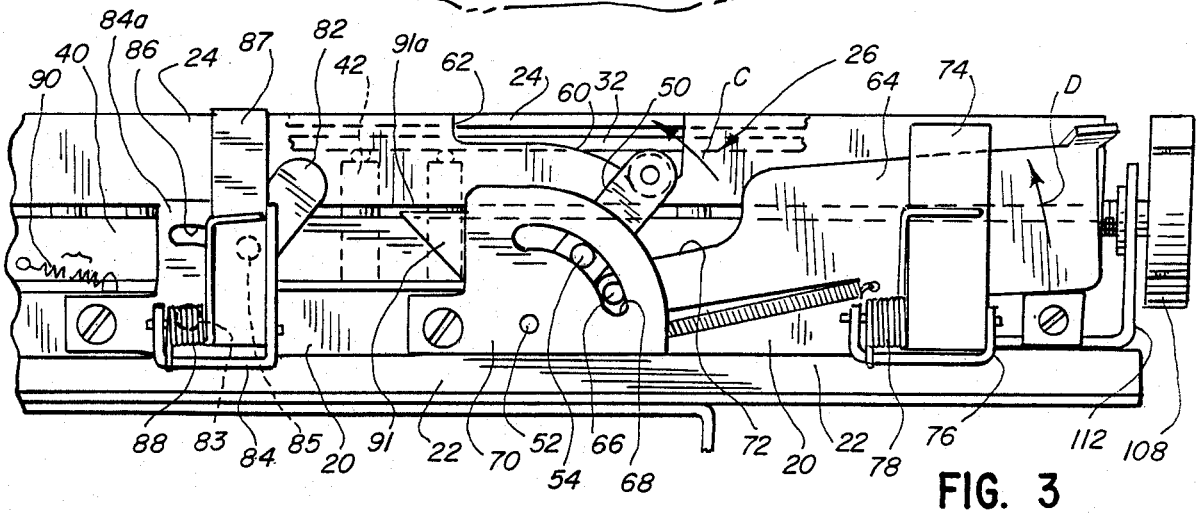
FIG. 3
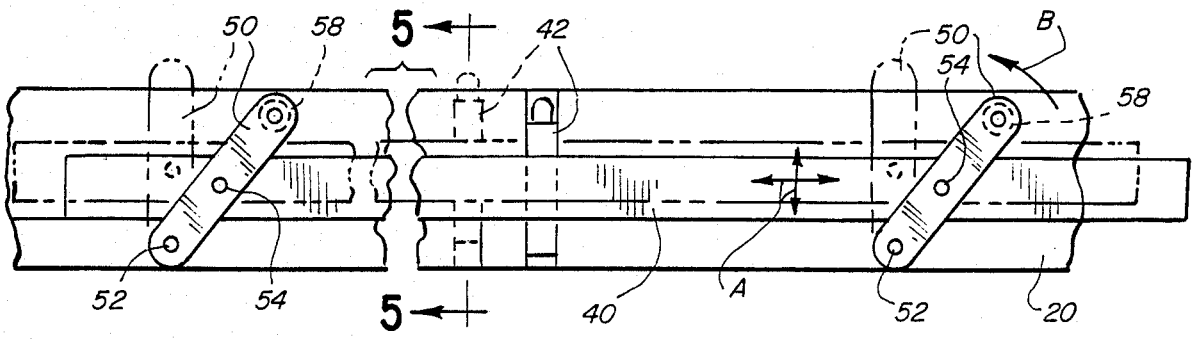
FIG. 4

MASTER HOLDING MECHANISM FOR DUPLICATING MACHINES

BACKGROUND OF THE INVENTION

This invention relates to a mechanism for holding a master, printing plate or the like on a cylinder of a duplicating, printing or like machine.

Printing machines are available for the production of copies with images formed on one or both sides of copy sheets. Such machines include printing couples which require master cylinders, blanket cylinders and impression cylinders. The master cylinders carry printing plates or masters with the images thereon to be duplicated.

There are various types of printing plates or masters used in printing or duplicating machines. For simplicity purposes, the term "master" or "masters" will be used at times herein to include printing plates for printing machines as well as masters for duplicating machines, all of which relate to the principles of printing techniques in the graphic arts field. In addition, it is known that masters are wrapped about a cylinder and held by both lead and trail edge holding devices. For simplification, the invention will be directed to holding the lead edge of the master, since the holding device will function in a printing mode without clamping the trail edge.

More specifically, clamping or holding devices or mechanisms are used with both unpunched and pre-punched masters. Conventionally, pre-punched masters are fabricated of metal or like material. Unpunched masters vary in materials and may be fabricated of paper, plastic or like materials, or even thin metal masters capable of being clamped.

When using unpunched masters, heretofore it has been conventional to hold the lead edge of the master in a clamping device extending transversely across the periphery of the cylinder. The clamping device customarily includes a planar anvil defining a gap with a movable clamping plate which grips the lead edge of the master against the anvil and holds the master by friction under the sheer magnitude of the clamping force. Such clamping devices create problems of slippage and often are complicated and expensive because of the forces required.

In the case of pre-punched masters, pins are inserted into the holes in the master along the lead edge thereof to lock the master onto the cylinder.

It is readily apparent that when changing a machine over from the use of unpunched to prepunched masters, or vice versa, there are losses in efficiency and production due to the downtime of the machine This is particularly critical and undesirable in industries where short run duplicating is performed.

This invention is directed to providing a universal holding device for masters of the character described, in that the device or mechanism will accommodate and hold pre-punched metal masters and unpunched masters of various materials, such as paper, plastic or the like, by the same method, in the same location and with the same mechanism. There is no downtime whatsoever in using the mechanism of this invention, except for the normal changing of the masters in short run duplicating.

SUMMARY OF THE INVENTION

An object, therefore, of the invention is to provide a new and improved mechanism for holding a master, printing plate or the like on a cylinder of a duplicating, printing or like machine.

In the exemplary embodiment of the invention, an elongated housing is mounted on the cylinder and includes an anvil extending transversely across the periphery of the cylinder. An elongated die plate extends along the housing above the anvil and defines a gap between the die plate and the anvil for receiving an edge of the master. The die plate has a series of holes spaced therealong. A pin bar extends along the housing below the anvil, and carries pins located in line with the holes in the die plate. Actuator means are operatively associated between the housing and the die plate, and between the housing and the pin bar, for conjointing moving the die plate toward the anvil to close the gap therebetween and moving the pins through the master and into the holes in the pin bar to hold the master securely in the gap. The pins have sharpened ends for piercing masters that are not provided with pre-punched perforations.

Movement of the die plate and pin bar are accomplished by a very simplified arrangement of cam levers and link arms. Specifically, a pair of cam levers is pivotally mounted on the housing, the levers having followers engageable with cooperative cam surfaces on the die plate for driving the die plate toward the anvil in response to rotation of the cam levers. The levers are connected to the pin bar by a parallelogram linkage for moving the pins into the holes in the die plate in response to rotation of the levers.

Other features of the invention include simplified means for adjusting the assembly of the anvil, the die plate and the pin bar. Specifically, the housing includes a base and the assembly is adjustable relative to the base transversely of the cylinder for properly centering the master relative thereto. The entire assembly also is adjustable angularly of the base for adjusting the skew of the master relative to the cylinder.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a somewhat schematic view taken radially through a cylinder to illustrate the location of the mechanism of this invention;

FIG. 2 is a perspective view of the mechanism mounted in a cutout in the cylinder;

FIG. 3 is a fragmented elevation of one transverse side of the mechanism;

FIG. 4 is a somewhat schematic, fragmented view illustrating the parallelogram linkage for moving the pin bar of the mechanism;

DETAILED DESCRIPTION OF THE PREFERRED EMBODIMENT

Figure 5:
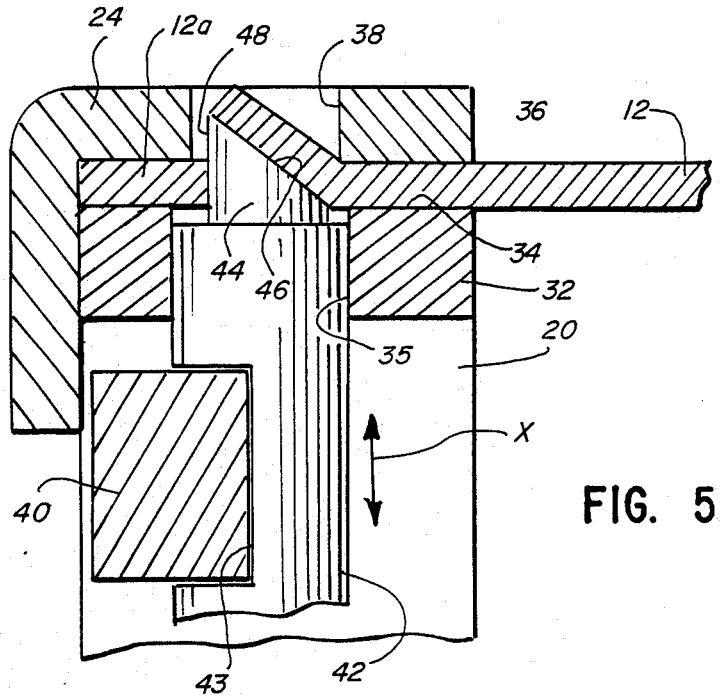
FIG. 5 is a fragmented section, on an enlarged scale, taken generally along line 5—5 of FIG. 4 to illustrate a pin piercing a master.

Referring to the drawings in greater detail, and first to FIG. 1, the invention is illustrated in conjunction with a cylinder 10 about which is wrapped a master or printing plate 12 having its lead edge 12*a* held by the mechanism of this invention, generally designated 14, and its trail edge 12*b* held by any appropriate clamping device, generally designated 16 and not described herein. It can be seen that the mechanism 14 of this invention is mounted in a cutout 18 of cylinder 10 so that lead edge 12*a* of master 12 is gripped or held substantially as a continuation of the outer cylindrical surface of the cylinder.

FIG. 2 shows, in greater detail, mechanism 14 mounted in cutout 18 of cylinder 10. The mechanism of this invention generally includes a housing 20, including a mounting base plate 22; a die plate 24; a pin bar which will be described in greater detail hereinafter; actuator means, generally designated 26; skew adjustment means, generally designated 28; and axial or transverse adjustment means, generally designated 30. These general operative devices or assemblies will be described in conjunction with the remaining figures of the drawings.

More specifically, referring to FIG. 5 in conjunction with FIG. 2, housing 20 is elongated and mounted on cylinder 10, and includes an anvil 32 extending transversely across the periphery of cylinder 10 to define an upper or radially outer anvil surface 34 (FIG. 5). Through holes 35 extend through anvil 32. Die plate 24 also is elongated and extends along housing 20 above anvil 32 as seen in FIG. 5 to define a gap 36 between die plate 24 and anvil 32 for receiving lead edge 12*a* of master 12. It can be seen in FIG. 5 that die plate 24 is L-shaped and sort of covers housing 20 and anvil 32 therebeneath. The die plate has a series of holes 38 spaced therealong as seen in FIG. 2.

Referring to FIG. 4 in conjunction with both FIGS. 2 and 5, a pin bar 40 extends along housing 20 below anvil 32 and is effective to move a plurality of pins 42 through holes 35 in anvil 32 and into and out of holes 38 in die plate 24. As seen in FIG. 5, each pin 42 has a cross groove 43 which embraces pin bar 40. Therefore, the bar can move transverse to the pins in a lost motion fashion, but still drive the pins axially in the direction of double-headed arrow "X".

Each pin is provided with a pointed or sharpened tip 44 (FIG. 5) formed by an angular distal end surface 46 whereby the tip is effective to pierce and hold an unpunched master. Such a piercing action is illustrated in FIG. 5 where it can be seen that the pointed ends of the pins do not completely puncture through the thickness of the master. By so limiting the movement of the pins through the master ensures that only a portion of tip 44 will pierce the master, causing a "half perforation", allowing the master to be held in place by the pins, but not allowing the formation of a slug or uncut portion to infiltrate into the printing system of the printing machine. However, it can be seen that the pins are capable of holding either an unpunched or a prepunched master, as the lead side 48 of each pin does project completely through the master into holes 38 in die plate 24.

The actuator means 26 for moving die plate 24 and pin bar 40 are shown in FIGS. 3 and 4 in conjunction with FIG. 2. More particularly, the actuator means include a pair of cam levers 50 pivotally mounted, at 52, on housing 20. The levers are pivotally mounted, at 54, to pin bar 40 (FIG. 4) to form a parallelogram linkage whereby the pin bar is moved in the direction of double-headed arrows "A" in a parallelogram motion to drive pins 42 through anvil 32 and pin tips 44 through master 12. In essence, linear movement of the pins is effected by pivotal movement of levers, 50 in the direction of double-headed arrow "B" (FIG. 4).

Pivotal movement of levers 50 in the direction of arrow "C" (FIG. 3) also is effective to draw die plate 24 downwardly toward anvil 32 to close the gap therebetween. Specifically, each lever 50 is provided with a cam roller 58 which rides along a cam surface 60 formed in a cutout 62 (FIG. 3) in the corner or edge of die plate 24. Therefore, pivotal movement of levers 50 in the direction of arrow "C" conjointly moves the die plate toward the anvil to close the gap therebetween and also effectively moves pins 42 through the master to either pierce and hold an unpunched master or to simply hold a prepunched master.

Actuator means 26 include an actuator handle 64 (FIGS. 2 and 3) for pivoting levers 50. Specifically, the handle includes a pin 66 which projects into an arcuate slot 68 in a bracket 70 fixed to housing base plate 22. On pivoting actuator handle 64 in the direction of arrow "D" (FIG. 3), about pin 66, a cutout portion 72 of the handle abuts lever 50 (the right-hand lever shown in FIG. 3) and pivots the lever in the direction of arrow "C". Of course, due to the parallelogram linkage shown in FIG. 4, pivoting movement of the actuator handle is effective to pivot both levers 50. A latch 74 is pivotally mounted by a bracket 76 (FIG. 3) to housing 20. The latch is spring loaded by a spring 78 and has a hook portion 80 (FIG. 2) which overlies the top edge of the handle when in its inoperative condition to hold the lever inoperative. The latch simply is moved against the biasing of spring 78 to allow movement of the handle to pivot levers 50. Slot 68 in bracket 70 provides a lost motion means for returning the actuator handle to its inoperative or cocked position while the die plate and pin bar are maintained in their closed and holding positions.

Locking means are provided for holding actuator means 26 in the closed and holding condition. More particularly, referring to FIG. 3, a locking link 82 is pivotally mounted, at 83, to a bracket 84 fixed to housing 20. The locking link has a pin connection 85 pivotally connected to pin bar 40 so as to be moved therewith. The outer end of pin connection 85 rides in an arcuate slot 86 in a flange portion 84*a* of bracket 84. A locking cam 87 is pivotally mounted on bracket 84 so that the locking cam pivots about an axis perpendicular to the pivoting axis of locking link 82. A spring 88 is loaded between bracket 84 and locking cam 87 to bias the cam into the path of movement, of locking link 82. Therefore, when pin bar 40 is moved by levers 50, locking link 82 bypasses locking cam 87 and the locking cam is biased by spring 88 into the path behind the locking link to hold the entire actuator means in gap-closed and pin-holding condition. When it is desirable to open the gap between the die plate a anvil, and to retract the pins, locking cam 87 simply is moved out of the path of locking link, 82 whereupon spring means 90 (FIGS. 2 and 3), interconnected between pin bar 40 and housing 20, is effective to move the pin bar to its original position and retract the pins. This, effectively, moves levers 50 opposite the direction of arrow "C" (FIG. 3) down cam surface 60. A bell crank-type arm 91 (see FIG. 3) is integral with each lever 50 and pivots therewith. As the levers move back to their original, inactive positions, arms 91 engage the underside of die plate 24, at 91*a*, to move the die plate upwardly and open the gap between the die plate and anvil 32.

Figure 6:
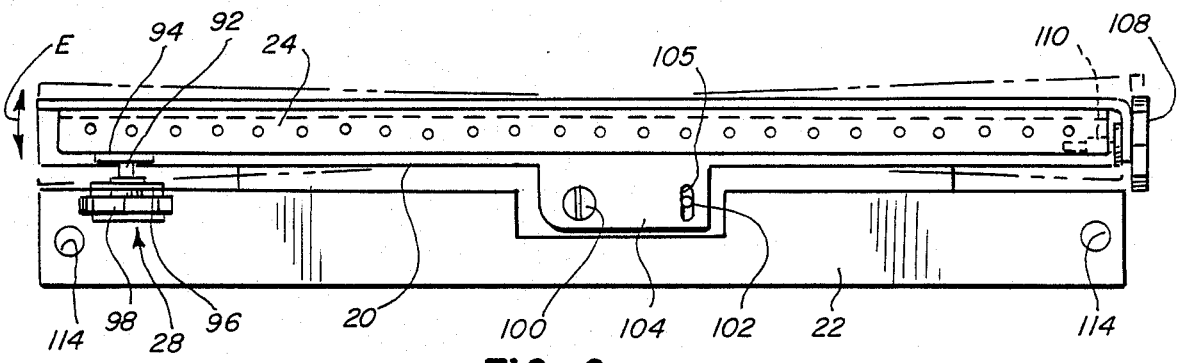
FIG. 6 is a top plan view of the mechanism, illustrating in phantom the angular adjustment of the mechanism.

FIG. 6 shows the operation of the adjustment means 28 for angularly adjusting the position of the entire assembly which includes housing 20 and die plate 24 as well as the pin bar and anvil which are not visible in these views, relative to mounting base plate 22 which is fixed to the cylinder. More particularly, a bolt 92 is threaded into a nut 94 fixed integral to housing 20. The opposite end of bolt 92 extends through and is freely rotatably mounted on a bracket 96 fixed to base plate 22. The bolt has a thumb head 98 which can be manually rotated to thread bolt 92 relative to nut 94 to effect movement of the entire assembly angularly in the direction of double-headed arrow "E". The assembly is pivotally mounted to base plate 22 by a pivot pin or bolt 100 and guided by a second locking bolt 102. Both pin 100 and bolt 102 extend through an ear portion 104 of housing 20, and bolt 102 can relatively move within a slot 105 in the ear portion to allow for angular adjustment Bolt 102 can be tightened to fix the angular position of the assembly.

Figure 7:
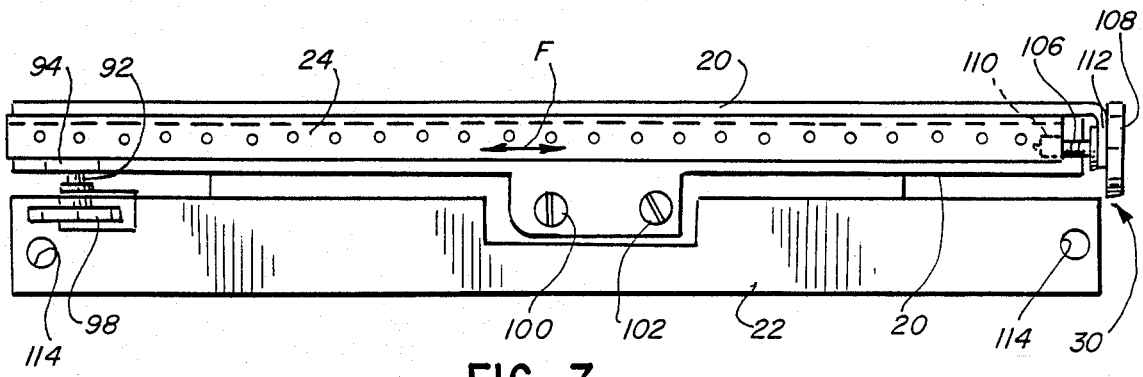
FIG. 7 is a view similar to that of FIG. 6, illustrating the longitudinal adjustment of the mechanism.

FIG. 7 shows the operation of the adjustment means 30 for axially adjusting the assembly which includes the die plate, pin bar and anvil. Specifically, a bolt 106 having a thumb head 108, the bolt being threaded into a nut 110 fixed integral with the anvil. The opposite end of bolt 106 extends through and is freely rotatably mounted on a bracket 112 integral with housing 20. Thumb head 108 can be manually rotated to thread bolt 106 relative to nut 110 to effect movement of the assembly axially in the direction of double-headed arrow "F".

Lastly, FIGS. 6 and 7 show aperture means 114 through the mounting base plate 22 for fixing the mechanism to cylinder 10.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A mechanism for holding a master, printing plate or the like on a cylinder of duplicating, printing or like machine, comprising:

an elongated housing mounted on the cylinder and including an anvil extending transversely across the periphery of the cylinder;

an elongated die plate extending along the housing in juxtaposition to the anvil defining a gap between the die plate and the anvil for receiving an edge of the master, the die plate having a series of holes spaced therealong;

a pin bar extending along the housing in juxtaposition to the anvil and having pins located in line with the holes in the die plate; and actuator means operatively associated between the housing and the die plate and between the housing and the pin bar for moving the die plate toward the anvil to close said gap and conjointly while independently moving the pins through the master and into the holes in the die plate to hold the master.

2. The mechanisms of claim 1 wherein said actuator or means includes at least a pair of cam levers pivotally mounted on the housing, the levers having cam followers engageable with cooperative cam surfaces on the die plate for driving the die plate toward the anvil in response to rotation of the cam levers.

3. The mechanism of claim 1 wherein said actuator means include a pair of levers pivotally mounted on the housing and connected to the pin bar by a parallelogram linkage for moving the pins into the holes in the die plate in response to rotation of the levers.

4. The mechanism of claim 3 wherein said levers have cam followers engageable with cooperative cam surfaces on the die plate for driving the die plate toward the anvil in response to rotation of the cam levers.

5. The mechanism of claim 4, including locking means for holding said actuator means in actuating condition.

6. The mechanism of claim 5, including release means for releasing said locking means.

7. The mechanism of claim 1, including locking means for holding said actuator means in actuating condition.

8. The mechanism of claim 7, including release means for releasing said locking means.

9. The mechanism of claim 1 wherein said actuator means include an actuator handle movable between a cocked position and an actuating position, and means for holding the actuator handle in its cocked position.

10. The mechanism of claim 9, including lost motion return means for returning the actuator handle to its cocked position while the die plate and pin bar are maintained in their closed and holding positions.

11. The mechanism of claim 1 wherein said pins have sharpened ends for piercing masters that are not provided with pre-punched perforations.

12. The mechanism of claim 1 wherein said housing includes base means for mounting the clamping mechanism on the cylinder, and including means for adjusting the assembly of said anvil, said die plate and said pin bar relative to the base means transversely of the cylinder for centering the master relative thereto.

13. The mechanism of claim 1 wherein said housing includes base means for mounting the clamping mechanism on the cylinder, and including means for angularly adjusting the assembly of said anvil, said die plate and said pin bar relative to the base means for adjusting the skew of the master relative to the cylinder.

14. The mechanism of claim 1 wherein said actuator means include means for moving said pins only partially through the master to hold the master but to prevent formation of residue pieces which might fall into the machine.

15. A mechanism for holding a master, printing plate or the like on a cylinder of a duplicating, printing or like machine, comprising:

an elongated housing mounted on the cylinder and extending transversely across the periphery of the cylinder;

an elongated die plate extending along the housing and having a series of holes spaced therealong;

a pin bar extending along the housing in juxtaposition to the die plate and having pins in line with the holes in the die plate, the pins having sharpened ends for piercing masters that are not provided with pre-punched perforations; and actuator means operatively associated between the die plate and the pin bar for effecting relative movement therebetween for moving the pins through a master and into the holes in the die plate to hold the master, including means for moving said pins only partially through the master to hold the master but to prevent formation of residue pieces which might fall into the machine.

16. The mechanism of claim 15 wherein said pins are sharpened by means of pointed ends formed by angular distal end surfaces.

* * * * *